United States Patent [19]

Sakurai et al.

[11] Patent Number: 4,886,427

[45] Date of Patent: Dec. 12, 1989

[54] HERMETIC SCROLL COMPRESSOR WITH PASSAGE GROUP FOR DISCHARGED FLUID

[75] Inventors: Kazuo Sakurai, Shizuoka; Takahiro Tamura, Shimizu, both of Japan

[73] Assignee: Hitachi, Ltd., Tokyo, Japan

[21] Appl. No.: 152,649

[22] Filed: Feb. 5, 1988

[30] Foreign Application Priority Data

Feb. 28, 1987 [JP] Japan ..... 62-45698

[51] Int. Cl.[4] ..... F04B 35/04; F04C 18/04; F04C 29/02

[52] U.S. Cl. ..... 417/369; 418/55

[58] Field of Search ..... 417/369, 410, 902; 418/55, DIG. 1

[56] References Cited

U.S. PATENT DOCUMENTS 4,730,997 3/1988 Tamura et al. ..... 418/55

FOREIGN PATENT DOCUMENTS 57-198384 12/1982 Japan .
60-224991 11/1985 Japan .

*Primary Examiner*—John J. Vrablik
*Attorney, Agent, or Firm*—Antonelli, Terry & Wands

[57] ABSTRACT

A hermetic scroll compressor comprising a compressor component and an electric motor arranged respectively in upper and lower portions of a closed housing. The compressor component includes fixed and orbiting scrolls in mesh with each other. A frame is fixedly connected to the fixed scroll and supports the orbiting scroll for orbiting motion, with at least one passage group of a plurality of vertically extending passages being provided at a peripheral surface of the frame for communicating a space above the compressor component with a space between the compressor component and the electric motor. One of the passages has a higher fluid resistance than the remaining passages, with the passage having high fluid resistance being vertically aligned with a passage provided at the periphery of the electric motor for communicating the space above the electric motor with a lubricating oil reservoir below the electric motor. A discharge pipe communicating with the outside of the closed housing is connected thereto at a location remote from the passage group as viewed in a rotational direction of a rotor of the electric motor.

8 Claims, 4 Drawing Sheets

HERMETIC SCROLL COMPRESSOR WITH PASSAGE GROUP FOR DISCHARGED FLUID

BACKGROUND OF THE INVENTION

The present invention relates to a hermetic scroll compressor and, more particularly, to an improvement for preventing an oil rise in which lubricating oil is accompanied by discharged gas and exits the compressor.

A hermetic scroll compressor is often used to compress refrigerant gas for an air conditioning system. Generally, the hermetic scroll compressor comprises a closed housing, a compressor component accommodated in an upper portion of the closed housing, and an electric motor accommodated in a lower portion of the closed housing for driving the compressor component. An oil reservoir for lubricating oil (hereinafter, also referred merely to "oil") is defined below the electric motor. The compressor component comprises fixed and orbiting scrolls each having their respective spiral wraps in the form of an involute or close thereto, which are in mesh with each other. The orbiting scroll is driven by a crankshaft such that the orbiting scroll moves in orbital motion without rotation about its own axis, relative to the fixed scroll. The crankshaft is driven by the above-mentioned electric motor. The fixed scroll, the orbiting scroll and the crankshaft are supported by a frame fixedly arranged within the closed housing. The oil is drawn up from the oil reservoir into an oil passage in the crankshaft to lubricate each bearing and sliding surfaces of the scrolls. Subsequently, the oil is discharged, together with refrigerant gas compressed at the compressor component, into a space within the closed housing above the compressor component. The discharged oil passes through a refrigerant passage defined between the frame and an inner peripheral wall surface of the closed housing, and enters a space below the frame. The oil further passes through refrigerant passages defined between the electric motor and the closed housing, and is returned to the oil reservoir. On the other hand, the refrigerant gas cools the electric motor and, subsequently, is discharged to the outside of the closed housing through a discharge pipe connected to the closed housing.

In the conventional hermetic scroll compressor, disclosed for example, in Japanese Patent Application Laid-Open Nos. 57-198384 and 60-224991, a refrigerant passage is provided which extends from the space within the closed housing above the compressor component, to the neighborhood or an upper coil end of the electric motor through a location between the frame and the inner peripheral wall surface of the closed housing. Separation of the oil contained in the refrigerant depends upon effects due to a change in velocity when the refrigerant impinges against the upper end of the electric motor and due to a reduction in velocity of the refrigerant at the outer periphery and a lower portion of the electric motor.

A disadvantage of the above-described prior art resides in the fact that when large amounts of oil are contained in the refrigerant, the oil is collected or stays on the upper portion of the electric motor, and the refrigerant gas impinges against the collected oil. By this reason, the oil is not sufficiently separated from the refrigerant. Conversely, the oil on the upper portion of the electric motor is blown up by the refrigerant, resulting in excessive oil rise. A further disadvantage resides in the fact that cooling of the lower portion of the electric motor is not necessarily sufficient.

SUMMARY OF THE INVENTION

It is an object of the invention to provide an improved hermetic scroll compressor wherein separation of oil contained in refrigerant gas is effected in an excellent manner in an attempt to reduce an amount of an oil rise, and a lower portion of an electric motor can sufficiently be cooled.

According to the invention, there is provided a hermetic scroll compressor comprising a closed housing, with a compressor component arranged in an upper portion of the housing. The compressor component comprises a fixed scroll, an orbiting scroll in mesh with the fixed scroll, and a frame fixedly connected to the fixed scroll and supporting the orbiting scroll for orbiting motion. The frame includes a peripheral surface in close contact with an inner peripheral wall surface of the closed housing, and an electric motor is arranged below the compressor component for driving the orbiting scroll. A lubricating oil reservoir is defined at a bottom of the closed housing below the electric motor, and a discharge pipe is connected to a space between the compressor component and the electric motor, with the discharge pipe communicating with the outside of the closed housing. A discharge port is provided at a center of the fixed scroll such that compressed refrigerant gas containing the lubricating oil is discharged from the discharge port to a space above the compressor component. At least one passage group of a plurality of vertically extending passages are provided for communicating the space above the compressor component with the space between the compressor component and the electric motor, with the passages being defined by the inner peripheral wall surface of the closed housing and a plurality of vertically extending grooves formed in the peripheral surface of the frame. One of the passages is higher in fluid resistance than the remaining passages, with the requisite number of the passage group being set in accordance with an amount of the gas discharged from the compressor. The hermetic scroll compressor is further characterized in that the passage having the high fluid resistance is vertically aligned with a passage which is provided at a part of a periphery of the electric motor for communicating the space above the electric motor with the lubricating oil reservoir below the electric motor, with the discharge pipe communicating with the outside of the closed housing being connected thereto at a location remote from the passages of the passage group as viewed in a rotational direction of a rotor of the electric motor.

The oil drawn up from the lubricating oil reservoir and having lubricated each bearing and sliding sections of the scrolls is discharged, in mixed relation to the refrigerant gas, from the discharge port at the center of the fixed scroll to the space above the compressor component. A part of the oil separated from the refrigerant gas at the space above the compressor component mainly passes through the passages having low fluid resistance, of the vertically extending passages formed on the peripheral surface of the frame. The oil flows down along the wall surface of the respective passages having low fluid resistance, and reaches the space between the compressor component and the electric motor. Subsequently, the oil flows down through the passage formed on a part of the peripheral surface of the electric motor, and is returned to the oil reservoir. On the other hand, the refrigerant gas flows from the space above the compressor component into the space between the compressor component and the electric motor through the vertically extending passages formed in the peripheral surface of the frame, to cool the upper portion of the electric motor. On this occasion, since the refrigerant gas passing through the passages having low fluid resistance, of the passages forming the passage group has a low in flow velocity, the oil contained in the refrigerant gas is separated and flows down so that the oil is returned to the oil reservoir. The refrigerant gas passing through the passage having high fluid resistance has a high flow velocity. Further, the passage having high fluid resistance is vertically aligned with the passage provided at a part of the periphery of the electric motor for communicating with the space below the electric motor. Accordingly, the refrigerant gas effectively passes through the passage provided at the periphery of the electric motor, and enters the space below the electric motor to cool the lower portion thereof. Subsequently, the refrigerant gas passes through another passage provided at the periphery of the electric motor and again enters the space between the electric motor and the compressor component. The refrigerant gas flows to the outside of the closed housing through the discharge pipe, with the oil separated from the refrigerant gas.

Moreover, since the discharge pipe is located at a position remote from the passages of the passage group in the rotational direction of the rotor, the separated oil is prevented from being accompanied by whirl flow induced by rotation of the rotor to the discharge pipe to be discharged therefrom.

As described above, in the hermetic scroll compressor according to the invention, an oil separating action or function is excellently performed whereby the oil contained in the compressed refrigerant gas is separated therefrom and is returned to the oil reservoir. Thus, the oil rise can effectively be prevented, and a sufficient amount of the refrigerant gas can be caused to flow to the lower portion of the electric motor to cool the same, making it possible to prevent a rise in temperature of coils at the lower portion of the electric motor.

DETAILED DESCRIPTION

Figure 1:
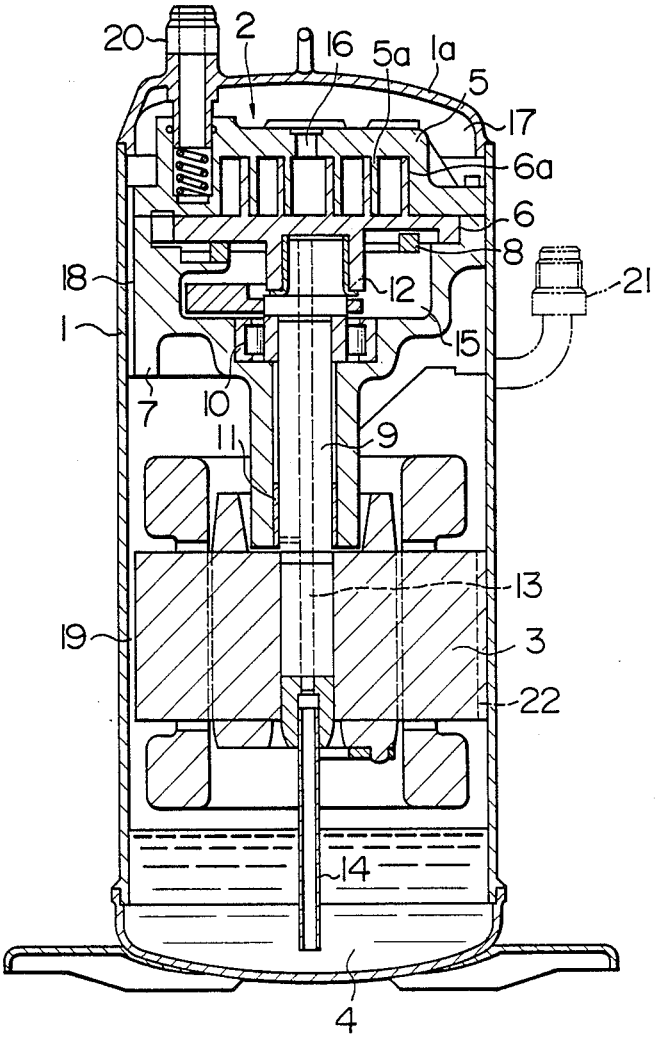
FIG. 1 is a longitudinal cross-sectional view of a hermetic scroll compressor according to an embodiment of the invention.

Referring now to the drawings wherein like reference numerals are used throughout the various view to designate like parts and, more particulary, to FIG. 1, according to this figure, a hermetic scroll component 2 and an electric motor 3 respectively arranged in upper and lower portions of the closed housing 1, and a lubricating oil reservoir 4 defined at a bottom of the closed housing 1. The compressor component 2 includes a fixed scroll 5 having an end plate and a spiral wrap 5*a* thereon, an orbiting scroll 6 having an end plate and a spiral wrap 6*a*, and a frame 7 is fixedly connected to the fixed scroll 5 and supports the orbiting scroll 6. The frame 7 is force-fitted in the closed housing 1 and is fixed thereto. The fixed and orbiting scrolls 5 and 6 are assembled with each other with their respective wraps 5*a* and 6*a* in mesh with each other. An Oldham mechanism 8 is provided between the orbiting scroll 6 and the frame 7 for preventing the orbiting scroll 6 from rotating about its own axis. The electric motor 3 is force-fitted in the closed housing 1 and is fixed thereto, for moving the orbiting scroll 6 in orbital motion through a crankshaft 9. The crankshaft 9 is supported by a main bearing 10 and a lower bearing 11 which are mounted in the frame 7. The crankshaft 9 has a crank pin which is fitted in an orbiting bearing 12 arranged on the rear face of the orbiting scroll 6.

A feed oil passage 13 is provided in the crankshaft 9 for introducing the lubricating oil to the main bearing 10, the lower bearing 11 and the orbiting bearing 12. An oil supply device 14 is provided at a lower end of the electric motor 3 for drawing up the lubricating oil within the oil reservoir 4 to feed the oil into the feed oil passage 13.

In the compressor component 2, as the orbiting scroll 6 is moved in orbital motion by the electric motor 3 through the crankshaft 9, pockets or compression chambers defined between the orbiting and fixed scrolls 6 and 5 are gradually reduced in volume while moving toward the center of the fixed scroll 5, to compress the drawn refrigerant gas. The compressed refrigerant gas is discharged into an upper space 17 within the closed housing 1 through a discharge port 16 provided at a center of the end plate of the fixed scroll 5.

Defined at the rear face of the orbiting scroll 6 is an intermediate pressure chamber 15 into which the gas under the compression stroke is introduced. Pressure within the intermediate pressure chamber 15 has a level intermediate between suction pressure and discharge pressure of the refrigerant gas. Differential pressure between the discharge pressure and the intermediate pressure is utilized to feed the oil to the sliding sections of the scrolls. The lubricating oil is caused to flow, by the oil supply device 14, through the feed oil passage 13 to lubricate the main bearing 10, the lower bearing 11 and the orbiting bearing 12. Subsequently, the lubricating oil flows into the compression chambers through the intermediate pressure chamber 15. The lubricating oil is discharged, in mixed relation to the refrigerant gas, from the discharge port 16 provided at the center of the fixed scroll 5 to the upper space 17 within the closed housing 1.

Figure 2A:
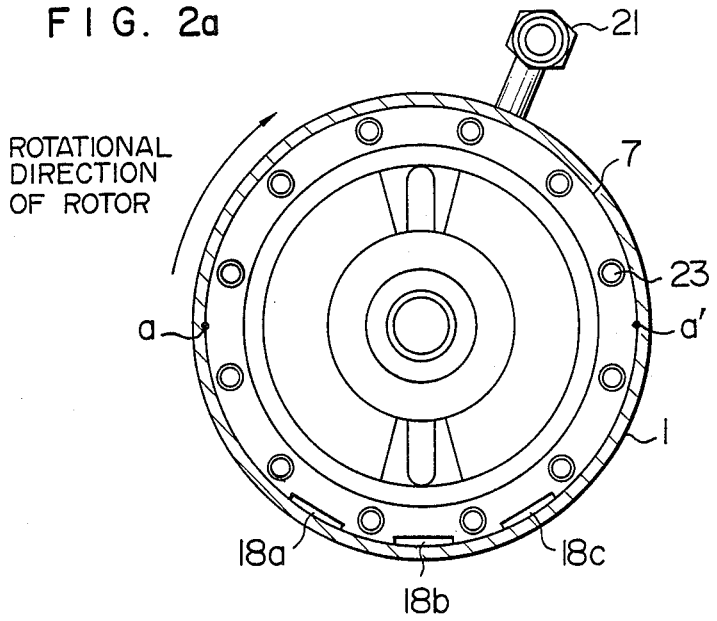
FIG. 2*a* is a top plan view of a frame illustrated in FIG. 1.
Figure 2B:
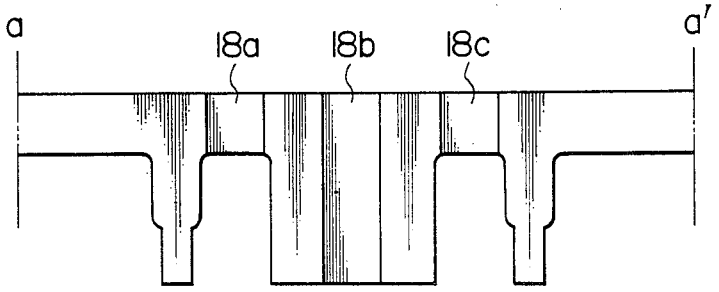
FIG. 2*b* is a developed view of a portion of an outer periphery extending from a position a to a position a', of the frame illustrated in FIG. 2*a;*

A plurality of grooves extending axially or vertically are provided in an outer periphery of the frame 7 as shown in FIGS. 2*a* and 2*b*. The grooves cooperate with an inner peripheral wall surface of the closed housing 1 to define a plurality of refrigerant passages 18 for introducing the refrigerant gas within the upper space 17 to a space below the compressor component 2. In the illustrated embodiment, the refrigerant passages 18 includes three passages **18*l*, 18*b* and 18*c* as shown in FIGS. 2*a* and 2*b*. Of the passages, the central passage 18*b* is formed to have fluid resistance higher than that of the passages 18*a* and 18*c* on either side of the central passage 18*b*. In order to make the fluid resistance of the respective passages different from each other, horizontal cross-sectional areas of the respective passages may be made different from each other, or axial or vertical lengths of the respective passages may be made different from each other. In the illustrated embodiment, the lengths are made different from each other. Specifically, the central passage 18*b* is longer than the passages 18*a* and 18*c* on either side of the central passage 18*b*. The passage 18*b* having high fluid resistance and the passages 18*a* and 18*c* having low fluid resistance form a single passage group. The reference numeral 23 denotes bores for bolts fastening the fixed scroll 5 to the frame 7**.

Figure 3:
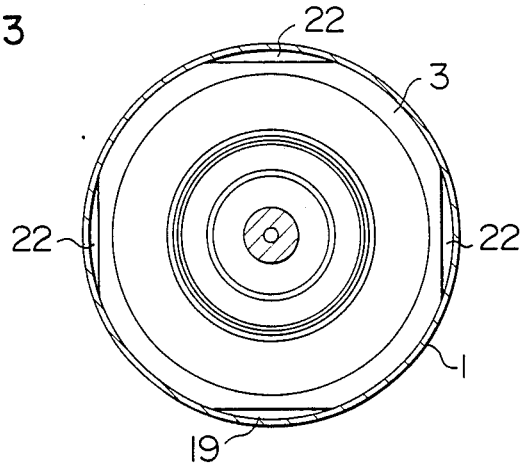
FIG. 3 is a top plan view of an electric motor illustrated in FIG. 1.

As shown in FIG. 3, the electric motor 3 has a core section which is partially cut at plural locations to define, between the electric motor 3 and the inner peripheral wall surface of the closed housing 1, a plurality of refrigerant passages 19 and 22 for communicating the space below the compressor component 2, that is, the space between a lower portion of the frame 7 and an upper portion of the electric motor 3, with the space below the electric motor 3. Of the refrigerant passage 18, the central passage **18*b* is located so as to be axially or vertically aligned with the passage 19 defined by the cut portion on the core section of the electric motor 3**.

As shown in FIG. 1, a suction pipe 20 extends through the wall of the closed housing 1 for introducing the refrigerant gas from the outside of the closed housing 1 to the suction side of the compressor component 2. A discharge pipe 21 is connected to the space within the closed housing 1 between the compressor component 2 and the electric motor 3, with the compressed gas flowing to the outside of the closed housing 1 through the discharge pipe 21. As will be seen from FIG. **2*a*, the discharge pipe 21 is connected to the closed housing 1 at a location remote from the passages 18*a*, 18*b* and 18*c* as viewed in the rotational direction of a rotor of the electric motor 3**.

In operation, as the orbiting scroll 6 is moved in orbital motion by the electric motor 3 through the crankshaft 9, the refrigerant gas drawn through the suction pipe 20 is compressed under the action of the fixed and orbiting scrolls 5 and 6. Subsequently, the compressed refrigerant gas is discharged, in mixed relation to the lubricating oil, from the discharge port 16 provided at the center of the fixed scroll 5 to the upper space 17 within the closed housing 1. The thus discharged refrigerant gas impinges against a closure cap **1*a* of the closed housing 1 so that the oil and the refrigerant gas are separated from each other, with the separated oil being accumulated for a time on the outer peripheral section of the upper portion of the fixed scroll 5. Subsequently, the oil passes mainly through the passages 18*a* and 18*c* on either side of the central passage 18*b*, which are low in fluid resistance, of the passages 18*a*, 18*b* and 18*c* provided at the frame 7. The oil flows along the inner peripheral wall surface of the closed housing 1, into the space below the compressor component 2, that is, the space between the frame 7 and the electric motor 3. On this occasion, the separated oil can smoothly flow down, because the passages 18*a* and 18*c* are low in fluid resistance. The oil entering the space between the frame 7 and the electric motor 3 then flows down under the effects of gravity through the passage 19 defined between the inner peripheral wall surface of the closed housing 1 and the cut portion on the core section of the electric motor 3. The oil then flows down into the oil reservoir 4 at the bottom of the closed housing 1**.

On the other hand, the refrigerant gas flows from the upper space 17 into the space between the frame 7 and the electric motor 3 through the passages **18*a*, 18*b* and 18*c*, to cool the upper portion of the electric motor 3. On this occasion, since the passages 18*a* and 18*c* on either side of the central passage 18*b* are low in fluid resistance, the refrigerant gas passing through these passages 18*a* and 18*c* is of a low velocity. Accordingly, the oil contained in the refrigerant gas is separated therefrom, and the separated oil adheres to the wall surfaces of the respective passages 18*c* and 18*c* and flows downwardly therealong, so that the oil reaches the oil reservoir 4. The passages 18*a*, 18*b* and 18*c* are arranged close to each other in a side by side relationship, and the oil collected for a time on the outer peripheral section of the upper portion of the fixed scroll 5 tends to flow first into the passages 18*a* and 18*c* on both sides of the passages 18*b* due to the low flow resistance of the passages 18*a*, 18*c*. Accordingly, the oil flows mainly into the passages 18*a* and 18*c*, and the refrigerant gas flows into the central passage 18*b* having the high flow resistance. Since the central passage 18*b* is longer than the passages 18*a* and 18*c* on either side thereof, the refrigerant gas passing through the central passage 18*b* is high in velocity at which the refrigerant gas impinges against the electric motor 3. Further, the central passage 18*b* is vertically aligned with the passage 19 which is formed by the cut portion on the core section of the electric motor 3 and which communicates with the lower portion of the electric motor 3. Thus, the refrigerant gas passing through the central passage 18*b* flows to the lower portion of the electric motor 3 through the passage 19, so that the lower portion of the electric motor 3 can effectively be cooled by the refrigerant gas. The refrigerant gas after having cooled the lower portion of the electric motor 3 passes through the remaining passages 22 at the outer periphery of the electric motor 3 and reaches the space thereabove. At this time, since the refrigerant gas has a low velocity, the oil contained in the refrigerant gas is separated therefrom and flows down to the oil reservoir 4. The refrigerant gas which has cooled the electric motor 3 in the manner as described above flows to the outside of the closed housing 1 through the discharge pipe 21**.

By rotation of the rotor of the electric motor 3, whirl flow in a direction identical with the rotational direction of the rotor is induced within the space between the electric motor 3 and the compressor component 2. Since, however, the discharge pipe 21 is connected to the closed housing 1 at the location remote from the passages **18*a*, 18*b* and 18*c* in the rotational direction of the rotor, the oil separated when flowing down through the passages 18*a* and 18*b* is not accompanied by the gas flowinng out through the dischargee pipe 21 and does not flow out, even though the separated oil is more or less influenced by the whirl flow. Moreover, the gas flow flowing down through the passage 18*b* is high in velocity and, in the illustrated embodiment, the passage 18*b* is long so that the distance is short from the lower open end of the passage 18*b* to the open end of the passage 19 provided at the core section or a stator of the electric motor 3. Therefore, the gas flow enters the passage 19** without being substantially influenced by the whirl flow.

Although the above embodiment has been described as having the passage group formed by three passages, it may be considered to increase the number of the passages forming the passage group, if an amount of refrigerant gas discharged increases due to an increase in the compressor capacity or the like.

Figure 4A:
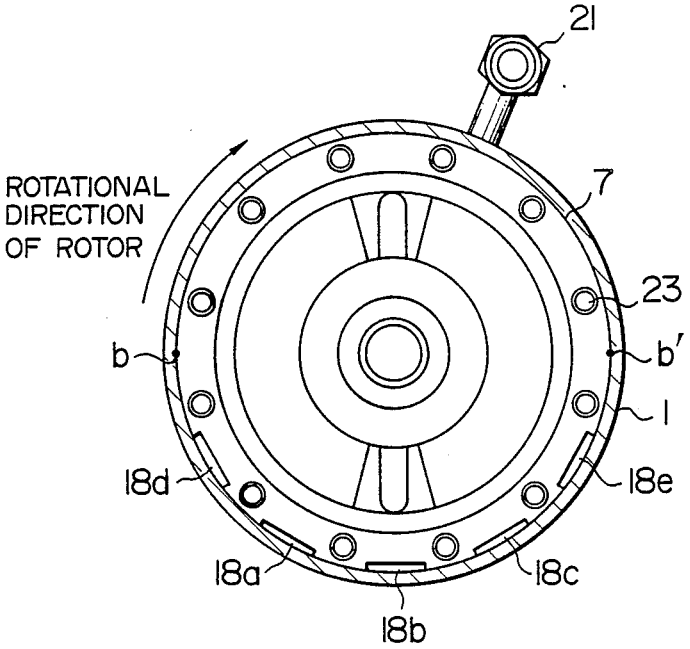
FIG. 4*a* is a top plan view showing a frame of a hermetic scroll compressor according to another embodiment of the invention.
Figure 4B:
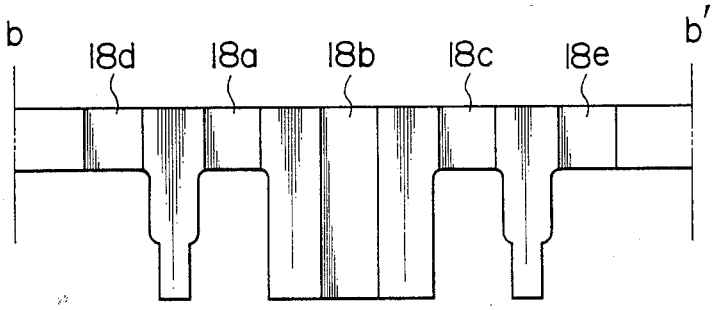
FIG. 4*b* is a developed view of a portion of an outer periphery extending from a position b to a position b', of the frame illustrated in FIG. 4*a;*

As shown in FIGS. 4*a* and 4*b*, five passages 18*a*, 18*b*, 18*c*, 18*d* and 18*e* extending axially or vertically are formed on the outer periphery of the frame 7. The central passage 18*b* has the greatest length and highest fluid resistance, with the passages 18*a*, 18*d*, 18*c* and 18*e* on either side of the central passage 18*b* having a shorter length and a low fluid resistance. These five passages form a single passage group. The discharge pipe 21 is connected to the closed housing 1 at a location remote from the passages 18*a* through 18*e* in the rotational direction of the rotor of the electric motor.

The refrigerant gas flow through the central passage 18*b* having the highest fluid resistance of the five passages, and the oil flows mainly through the remaining four passages 18*a*, 18*d*, 18*c* and 18*e* having low fluid resistance.

The remaining structure of the embodiment illustrated in FIGS. 4*a* and 4*b* is similar to that of the embodiment illustrated in FIGS. 1 through 3, and the description of the remaining structure will therefore be omitted.

Figure 5A:
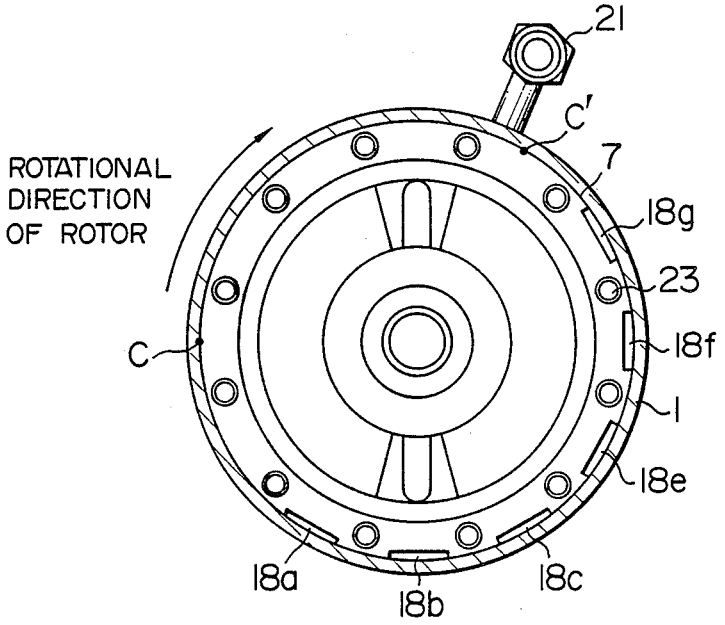
FIG. 5*a* is a top plan view showing a frame of a hermetic scroll compressor according to still another embodiment of the invention.
Figure 5B:
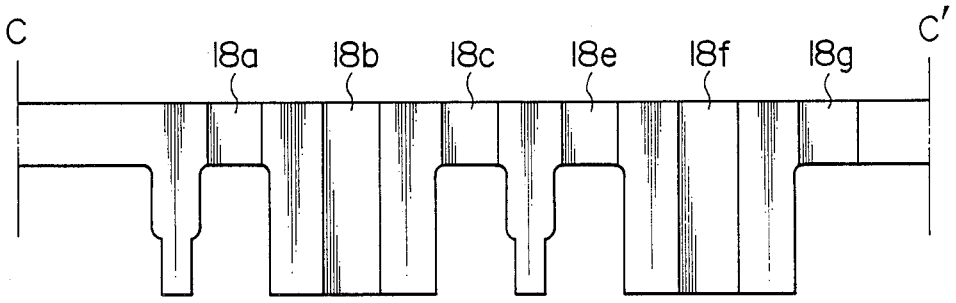
FIG. 5*b* is a developed view of a portion of an outer periphery extending from a position c to a position c', of the frame illustrated in FIG. 5*a.*

As shown in FIGS. 5*a* and 5*b*, six passages 18*a*, 18*b*, 18*c*, 18*e*, 18*f* and 18*g* extending axially or vertically are formed in the outer periphery of the frame 7. The passages 18*a*, 18*b* and 18*c* form a first passage group, while the passages 18*e*, 18*f* and 18*g* form a second passage group. In each of the first and second passage groups, the central passage 18*b*, 18*f* has the greatest length and highest fluid resistance, with the remaining passages 18*a*, 18*c*, 18*e*, 18*g* being shorter in length and having a low fluid resistance. Like the above-described embodiments, the discharge pipe 21 is connected to the closed housing 1 at a location remote from the passages 18*a*, 18*b*, 18*c*, 18*e*, 18*f* and 18*g* in the rotational direction of the rotor of the electric motor.

Each of the first and second passage groups is similar in function to the passage group of the embodiment illustrated in FIGS. 2*a* and 2*b*. The remaining structure of the embodiment shown in FIGS. 5*a* and 5*b* is similar to that of the embodiment illustrated in FIG. 1, and the description of the remaining structure will therefore be omitted.

What is claimed is:

1. A hermetic scroll compressor comprising:

a closed housing;

a compressor component arranged in an upper portion of said closed housing comprising a fixed scroll, an orbiting scroll in mesh with said fixed scroll, and a frame fixedly connected to said fixed scroll and supporting said orbiting scroll for orbiting motion, said frame having a peripheral surface and close contact with an inner peripheral wall surface of said closed housing;

an electric motor arranged below said compressor component for driving said orbiting scroll, said electric motor having a rotor;

a lubricating oil reservoir defined in a bottom of said closed housing below said electric motor;

a discharge pipe connected to a space between said compressor component and said electric motor and communicating with the outside of said closed housing;

a discharge port provided at a center of said fixed scroll such that compressed refrigerant gas containing lubricating oil is discharged from said discharge port to a space above said compressor component;

at least one passage group of a plurality of vertically extending passages for communicating the space above said compressor component with the space between said compressor component and said electric motor, said passages of said at least one passage group being defined by the inner peripheral wall surface of said closed housing and a plurality of vertically extending grooves formed in the peripheral surface of said frame, one of said passages of said at least one passage group being higher in fluid resistance than the remaining passages, wherein said passage having the high fluid resistance is longer than the remaining passages; and a passage provided at a part of a periphery of said electric motor for communicating the space above said electric motor with said lubricating oil reservoir below said electric motor, said passage having a high fluid resistance being vertically aligned with said passage provided at the periphery of said electric motor, and wherein said discharge pipe is connected to said closed housing at a location remote from said passages of said at least one passage group as viewed in a rotational direction of the rotor of said electric motor.

2. A hermetic scroll compressor as defined in claim 1, wherein said at least one passage group includes at least three passages, with one of said three passages being higher in fluid resistance than the remaining passages.

3. A hermetic scroll compressor as defined in claim 2, wherein said at least one passage group includes at least five passages, with one of said five passages being higher in fluid resistance than the remaining passages.

4. A hermetic scroll compressor according to claim 2, wherein said one passage of high flow resistance is disposed substantially centrally of the remaining passages.

5. A hermetic scroll compressor comprising:

a closed housing;

a compressor component arranged in an upper portion of said closed housing comprising a fixed scroll, an orbiting scroll in mesh with said fixed scroll, and a frame fixedly connected to said fixed scroll and supporting said orbiting scroll for orbiting motion, said frame having a peripheral surface in close contact with an inner peripheral wall surface of said closed housing;

an electric motor arranged below said compressor component for driving said orbiting scroll member, said electric motor having a rotor;

a lubricating oil reservoir defined at a bottom of said closed housing below said electric motor;

a discharge pipe connected to a space between said compressor component and said electric motor and communicating with an outside of said closed housing;

a discharge port provided at a center of said fixed scroll such that compressed refrigerant gas containing lubricating oil is discharged from said discharge port to a space above said compressor component;

at least two passage groups of a plurality of vertically extending passages for communicating the space above said compressor component with the space between said compressor component and said electric motor, said passages of said at least two passage groups being defined by the inner peripheral wall surface of said closed housing and a plurality of vertically extending grooves formed in the peripheral surface of said frame, one of said passages of said at least two groups of passages having a length longer than a length of the remaining passages so as to have a higher fluid resistance than the remaining passages; and a passage provided at a part of the periphery of said electric motor for communicating the space above said electric motor with said lubricating oil reservoir, said passage having high fluid resistance being vertically aligned with said passage provided at the periphery of said electric motor, and wherein said discharge pipe is connected to said closed housing at a location remote from said passages of said at least two passage groups as viewed in a rotational direction of the rotor of said electric motor.

6. A hermetic scroll compressor according to claim 5, wherein each said two passage groups includes at least three passages.

7. A hermetic scroll compressor according to claim 6, wherein one passage of each of said at least two passage groups has a higher fluid resistance than the remaining passages in the respective passage groups.

8. A hermetic scroll compressor according to claim 7, wherein the one passage of higher fluid resistance of each of said at least two passage groups is disposed between the passages of low resistance of the respective groups.

* * * * *